US007731539B2

(12) United States Patent
Ooaku

(10) Patent No.: US 7,731,539 B2
(45) Date of Patent: Jun. 8, 2010

(54) CONNECTOR FOR MEMORY CARD

(75) Inventor: Kiyoshi Ooaku, Tokyo (JP)

(73) Assignee: Honda Tsushin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 12/320,249

(22) Filed: Jan. 22, 2009

(65) Prior Publication Data

US 2009/0186498 A1 Jul. 23, 2009

(30) Foreign Application Priority Data

Jan. 23, 2008 (JP) ..... 2008-012505

(51) Int. Cl.
*H01R 24/00* (2006.01)

(52) U.S. Cl. ..... 439/630

(58) Field of Classification Search ..... 439/630, 439/59, 629, 159, 79, 83, 540
See application file for complete search history.

(56) References Cited

U.S. PATENT DOCUMENTS 5,318,452 A * 6/1994 Brennian et al. ..... 439/79
6,733,340 B2 * 5/2004 Nishio et al. ..... 439/630
7,174,628 B1 * 2/2007 Wang et al. ..... 29/841
2005/0009406 A1 * 1/2005 Chang ..... 439/638
2009/0111288 A1 * 4/2009 Harada ..... 439/59

FOREIGN PATENT DOCUMENTS

JP 2006-164604 6/2006

* cited by examiner

*Primary Examiner*—Jean F Duverne
(74) *Attorney, Agent, or Firm*—Wenderoth, Lind & Ponack, L.L.P.

(57) ABSTRACT

In order to provide a connector for a memory card that seeks the reduction of the number of parts and the reduction of costs, there is provided a connector for a memory card including an insulating housing having plural power contacts and signal contacts lined up, and an accommodating unit for allowing installation of a memory card therein to bring an electric circuit in the memory card and an electric circuit on a printed circuit board into electrical connection through the power contacts and the signal contacts. A detecting contact for detecting that the memory card has been installed in the accommodating unit is further provided in the insulating housing along the power contact and the signal contact, and a leading end of the detecting contact is placed so as to be in contact with a pad of the memory card accommodated in the accommodating unit.

6 Claims, 3 Drawing Sheets

CONNECTOR FOR MEMORY CARD

BACKGROUND OF THE INVENTION

1. Field of the Invention

The present invention relates to a connector that accommodates a memory card such as a micro SD card that is mainly used for data recording in a cellular phone and is to be mounted on a surface of a printed circuit board.

2. Prior Art

A conventional connector for a memory card disclosed in JP-A-2006-164604 has been known. As shown in FIG. 5, in a connector 1*a* for a memory card, if a memory card 2 is accommodated in an accommodating unit 3, a power supply pad 2*a* or signal pad 2*b* on one side of the memory card 2 is brought into slidable contact with a power supply contact 4*a* or a signal contact 4*b* provided in parallel at corresponding pitches thereby connecting electrically. On the other hand, on the side of the memory card 2, a part of a detecting contact 5*a* intruding into the accommodating space is pushed out to the outside. Thus, this part of the detecting contact 5*a* is brought into contact with a detecting contact 5*b* which leads to a detecting circuit on a printed circuit board side thereby connecting electrically. Therefore, the fact that the memory card 2 has been installed in the accommodating unit 3 can be electrically detected.

However, in the conventional connector 1*a* for a memory card, the two detecting contacts 5*a* and 5*b* are provided in an insulating housing of the connector 1*a* as means for detecting the installation of a memory card. This increases the cost for detecting the installation of a memory card, imposes a load of parts control and increases the number of steps of assembly, which are problems.

SUMMARY OF THE INVENTION

In view of the conventional problems, it is an object of the present invention to provide a connector for a memory card that allows the reduction of the number of detecting contacts and reduction of the costs.

According to an aspect of the invention, there is provided a connector for a memory card including an insulating housing having plural power contacts and signal contacts lined up, and an accommodating unit for allowing installation of a memory card therein to bring an electric circuit in the memory card and an electric circuit on a printed circuit board into electrical connection through the power contacts and the signal contacts, wherein a detecting contact for detecting that the memory card has been installed in the accommodating unit is further provided in the insulating housing along the power contact and the signal contact, and a leading end of the detecting contact is placed so as to be in contact with a pad of the memory card accommodated in the accommodating unit.

Preferably, a back end of the detecting contact is placed so as to connect with a detecting circuit on the printed circuit board, and the leading end of the detecting contact is placed so as to be abutted against a power supply pad of the memory card.

According to a connector for a memory card of the invention, a leading end of the detecting contact is placed so as to be in contact with a pad of the memory card accommodated in an accommodating unit, and therefore, the pad of the memory card accommodated in the accommodating unit can also be used as a detecting contact, which can reduce the number of contacts.

Furthermore, placing the back end of the detecting contact so as to connect with a detecting circuit on the printed circuit board and placing the leading end of the detecting contact so as to be abutted against a power supply pad of a memory card can reduce the costs and can reduce the mounting area more than that of a conventional connector which is provided within contacts and projects to a side of the insulating housing. Therefore, the effective mounting area can be increased on the printed circuit board.

BRIEF DESCRIPTION OF THE DRAWINGS

FIGS. 1B and 10 are a bottom view and a side elevation view, respectively, of the connector showing a state with the shell attached;

DETAILED DESCRIPTION OF THE PREFERRED EMBODIMENTS

Figure 1A:
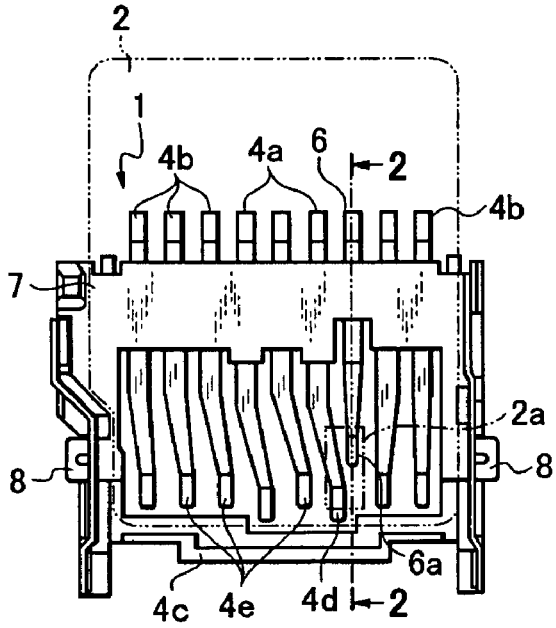
FIG. 1A is a plan view showing a connector for a memory card, in a state with a shell removed, according to an embodiment of the invention.
Figure 1B:
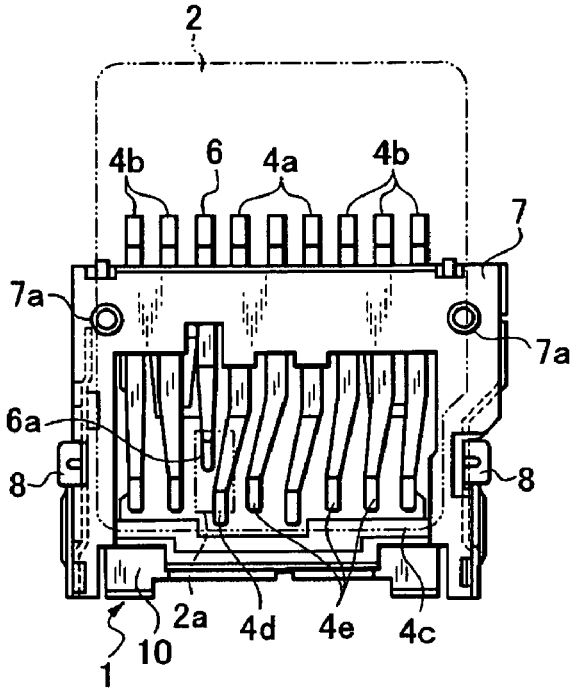
Figure 1C:
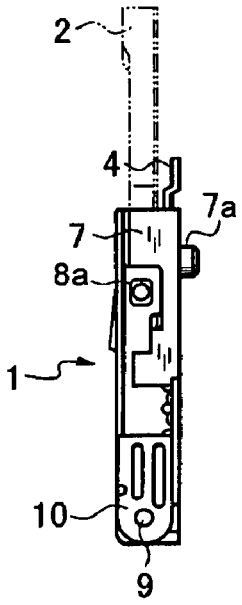
Figure 2:
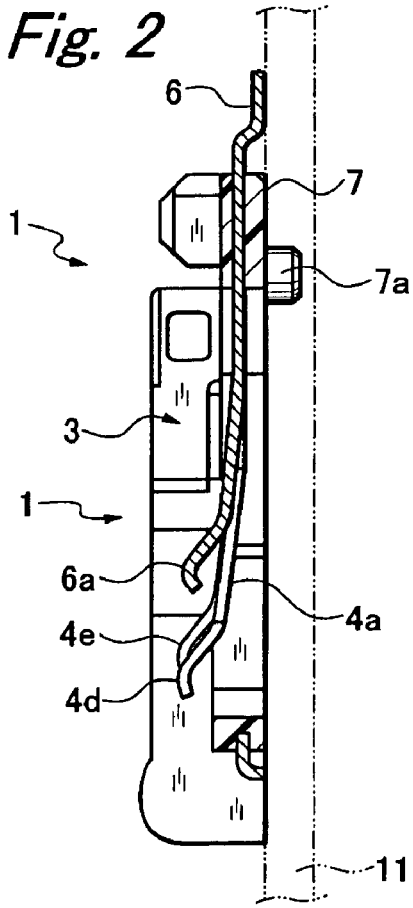
FIG. 2 is a sectional view taken along the line 2-2 in FIG. 1A.
Figure 4A:
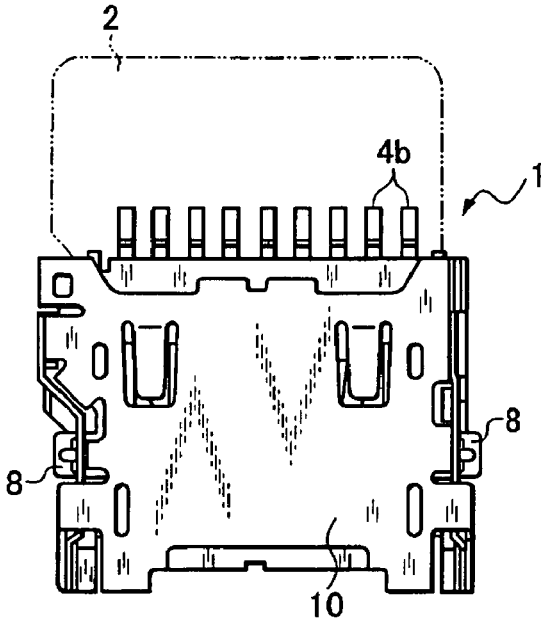
FIGS. 4A, 4B and 4C are a plan view, a front view and a side view, respectively, showing the connector for a memory card.
Figure 4B:
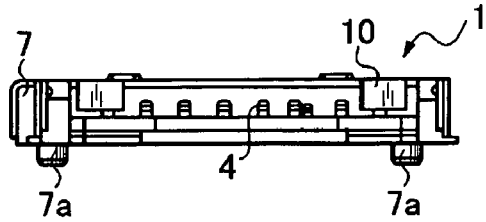
Figure 4C:
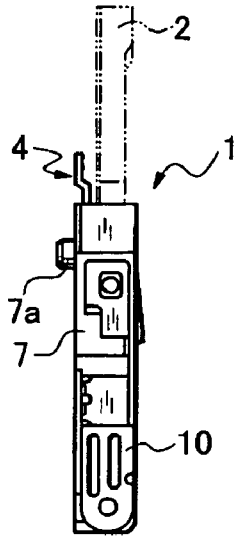

A connector 1 for a memory card according to the invention will be described by referring to the parts corresponding to those of the conventional connector 1*a* for a memory card with identical reference numerals. The connector 1 for a memory card, as shown in FIGS. 1A and 1B, is a connector allowing the installation of a memory card 2 (refer to FIGS. 4A and 4C) into an accommodating unit 3 in an insulating housing 7 to bring an electric circuit in the memory card 2 and an electric circuit on a printed circuit board 11 shown in FIG. 2 into electrical connection through a power contact 4*a* and a signal contact 4*b* lined up in the insulating housing 7.

Figure 5:
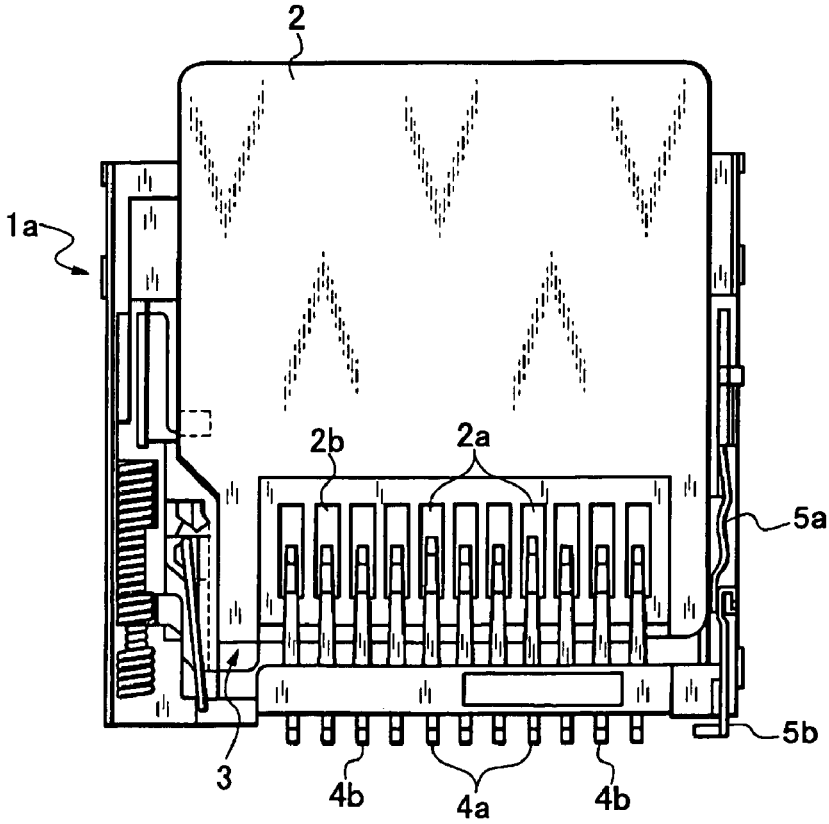
Fig. 5 PRIOR ART
FIG. 5 is a plan view showing a conventional connector for a memory card in use, in a state with a shell removed.

A detecting contact 6 for detecting that the memory card 2 has been installed in the accommodating unit 3 is additionally provided in the insulating housing 7 along the power contact 4*a* and the signal contact 4*b*, and a leading end 6*a* of the detecting contact 6 is placed to be in contact with a pad of the memory card 2 accommodated in the accommodating unit 3. In other words, a back end of the detecting contact 6 is placed so as to connect with a detecting circuit on the printed circuit board 11, and the leading end 6*a* of the detecting contact 6 is placed so as to be abutted against a power supply pad 2*a* (refer to FIG. 5) of the memory card 2.

The detecting contact 6 is placed closely to and by the power supply contact 4*a*. As shown in FIGS. 1A and 1B, the leading end 4*d* of the power contact 4*a* and the leading end 6*a* of detecting contact 6 are abutted against one power pad 2*a*, thereby allowing the power pad 2*a* and the power contact 4*a* to be shared as the detecting contact.

In another aspect, the detecting contact 6 is placed among plural power contacts 4*a* and signal contacts 4*b* (contact group), and the leading ends of all the contacts (4*a*, 4*b* and 6) in the contact group are placed for the corresponding pads 2*a*, 2*b* . . . of the memory card 2. A back end of the detecting contact 6 is added to the back ends 4*a*, 4*b* and so on of the contacts on the printed circuit board 11. However, they are fit within the width of the insulating housing 7. Therefore, a narrower mounting area can be achieved for the connector 1 for a memory card than the conventional one for the connector

1*a* for a memory card, which is wider because the detecting contact is provided on a side of the insulating housing 7. As a result, this can increase the effective mounting area on the printed circuit board 11.

Figure 3B:
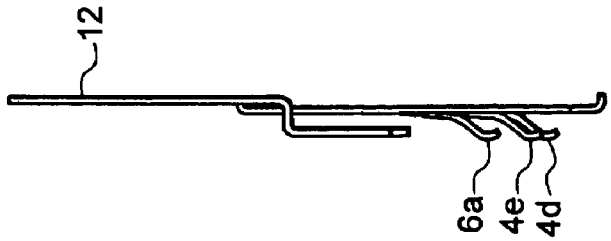
FIGS. 3A and 3B are a plan view and a side elevation view, respectively, showing a carrier having contacts in the connector for a memory card.
Figure 3A:
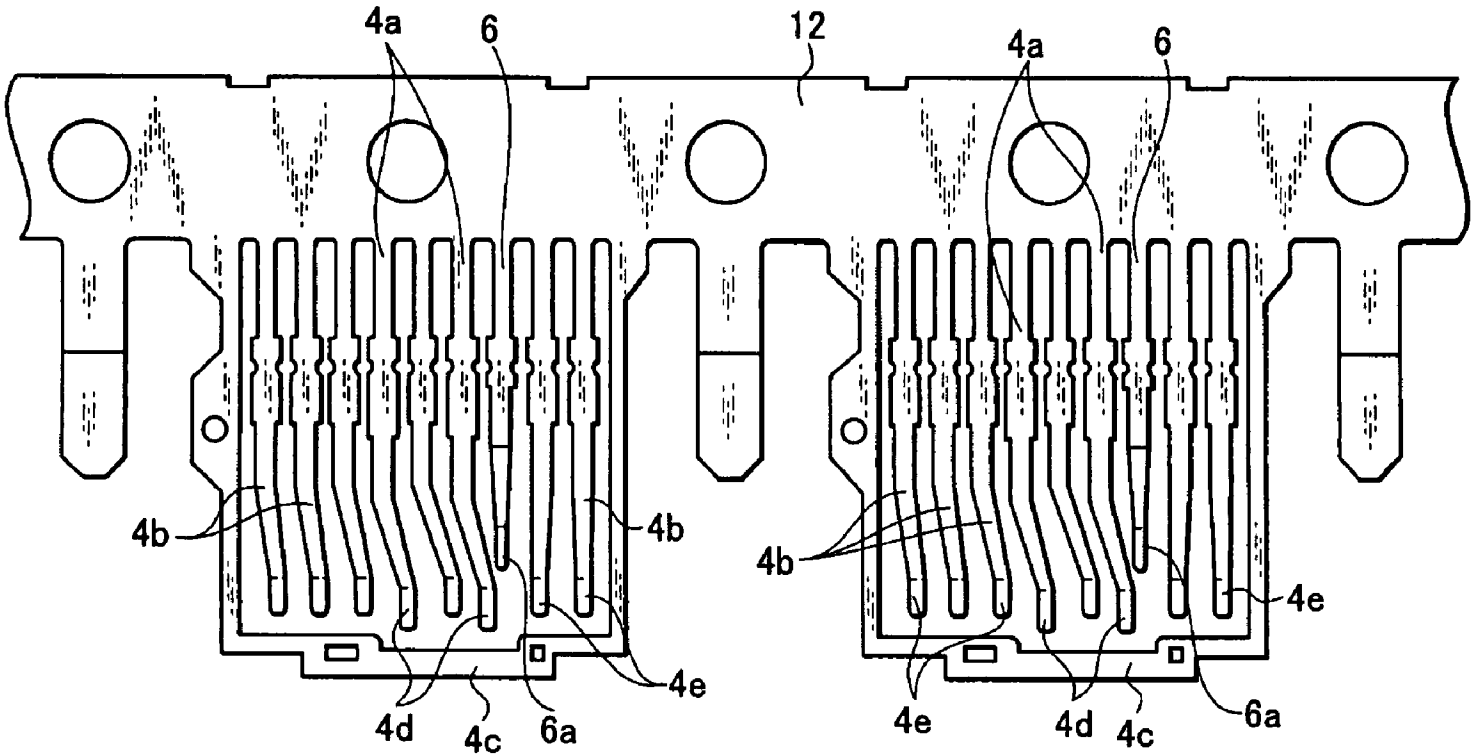

In the connector 1 for a memory card according to the invention, contacts to be integrated in the insulating housing 7 by insert molding are formed on a carrier 12 of a metal sheet, as shown in FIGS. 3A and 3B. The contacts 4*a*, 4*b*, . . . and 6 are surrounded by a reinforcing plate 4*c* for reinforcing the insulating housing 7.

A positioning boss 7*a* is used for attachment to the printed circuit board 11, and a holddown 8 is used for fixing to the printed circuit board 11. A pivot 9 supports a metallic shell 10 pivotably. As shown in FIGS. 1B and 10 and FIGS. 4A to 4C, the memory card 2 is installed into and is held within the shell 10, is pivoted about the pivot 9 with the state and is latched with a small window 8*a* of the holddown 8. Then, the shell 10 is closed, and the memory card 2 is accommodated in the accommodating unit 3 of the insulating housing 7.

In the connector 1 for a memory card, one detecting contact 6 is provided, and the leading end 6*a* is brought into slidable contact with the power pad 2*a* of the memory card 2. Thus, the power pad 2*a* and the power contact 4*a* can be shared as the detecting contact, which can eliminate the necessity for the contact between two independently provided detecting contacts as in conventional technologies.

What is claimed is:

1. A memory card connector for a memory card, said memory card connector comprising an insulating housing having plural contacts including a power contact and a signal contact lined up, and an accommodating unit for allowing installation of the memory card therein to bring an electric circuit in the memory card and an electric circuit on a printed circuit board into electrical connection through the power contact and the signal contact, wherein:

a detecting contact for detecting that the memory card has been installed in the accommodating unit is further provided in the insulating housing along with the power contact and the signal contact so as to be placed among the plural contacts including the power contact and the signal contact, and a leading end of the detecting contact is placed so as to be in contact with a pad of the memory card when the memory card is accommodated in the accommodating unit.

2. The memory card connector according to claim 1, wherein a back end of the detecting contact is placed so as to connect with a detecting circuit on the printed circuit board, and the leading end of the detecting contact is placed so as to be abutted against a power supply pad of the memory card when the memory card is accommodated in the accommodating unit.

3. The memory card connector according to claim 2, wherein said power contact has a leading end placed so as to be abutted against the power supply pad of the memory card when the memory card is accommodated in the accommodating unit.

4. The memory card connector according to claim 3, wherein a back end of the detecting contact is placed so as to connect with a detecting circuit on the printed circuit board, and the leading end of the detecting contact is placed so as to be abutted against a power supply pad of the memory card when the memory card is accommodated in the accommodating unit.

5. The memory card connector according to claim 4, wherein said power contact has a leading end placed so as to be abutted against the power supply pad of the memory card when the memory card is accommodated in the accommodating unit.

6. A memory card connector for connecting an electric circuit of a memory card to an electric circuit of a circuit board, said memory card connector comprising:

an insulating housing;

an accommodating unit provided to the insulating housing to accommodate the memory card;

a plurality of contacts mounted to said insulating housing and aligned in a row for connection to the memory card;

wherein said contacts include a power contact, a signal contact, and a memory card detecting contact for detecting that the memory card has been installed in the accommodating unit;

wherein said memory card detecting contact has a leading end located so as to be in contact with a pad of the memory card when the memory card is accommodated in said accommodating unit; and wherein said memory card detecting contact is arranged among said power contact and said signal contact and aligned in said row therewith.

* * * * *